United States Patent [19]

Couls et al.

[11] Patent Number: 4,941,632

[45] Date of Patent: Jul. 17, 1990

[54] PEGBOARD HOOK RETAINING CLIP

[76] Inventors: Donald E. Couls, 48150 Furgot, Utica, Mich. 48087; William J. Love, 32129 Block, Garden City, Mich. 48135

[21] Appl. No.: 292,446

[22] Filed: Dec. 30, 1988

[51] Int. Cl.[5] ..... A47B 96/06

[52] U.S. Cl. ..... 248/221.2; 248/222.1

[58] Field of Search ..... 248/220.3, 220.2, 220.4, 248/221.1, 221.2, 221.3, 222.1; 211/187

[56] References Cited

U.S. PATENT DOCUMENTS

| | | | |
|---|---|---|---|
| 3,241,799 | 3/1966 | Terlinde | 248/222.1 X |
| 3,879,006 | 4/1975 | Staudte, Jr. | 248/221.2 |
| 4,105,179 | 8/1978 | Elliott | 248/221.2 |
| 4,645,154 | 2/1987 | Bly | 248/220.4 |
| 4,714,221 | 12/1987 | Cawrey | 248/221.1 |
| 4,799,637 | 1/1989 | Fahringer | 248/221.2 |

FOREIGN PATENT DOCUMENTS

| | | | |
|---|---|---|---|
| 1049478 | 2/1979 | Canada | 248/220.3 |
| 1472212 | 1/1967 | France | 248/220.3 |

*Primary Examiner*—Ramon O. Ramirez

*Attorney, Agent, or Firm*—Charles W. Chandler

[57] ABSTRACT

A retaining clip for a pegboard hook of the type having upper and lower fingers receivable in adjacent holes of the pegboard. The clip has an elongated sheet metal body having a slot for receiving the upper end of the hook, and a retaining tab disposed adjacent the lower end of the hook shank to prevent the hook from being removed from the pegboard unless the retaining clip is swung out of the way.

8 Claims, 1 Drawing Sheet

PEGBOARD HOOK RETAINING CLIP

BACKGROUND OF THE INVENTION

This invention is related to pegboard hook retainers, and more particularly to a retainer for a hook of the type having an upper elbow and a lower finger receivable in adjacent apertures in the pegboard.

Pegboard hooks are commonly employed for mounting tools and the like in a raised position on pegboards. The problem with pegboard hooks is that they tend to become loose as the pegboard apertures become enlarged.

A typical pegboard hook of a type to which the present invention pertains, is an elongated wire member having an upper elbow received in the pegboard. The lower end has any of a variety of configurations depending upon the article that is to be suspended. The hook has a linear shank supported parallel to the pegboard, and a finger received in an aperture below that of the elbow.

One approach for improving the stability of such hooks is to provide a retainer clip, combined in some way with the hook, to prevent it from being loosened or accidently removed from the pegboard. One such device is illustrated in U.S. Pat. No. 4,105,179, which issued Aug. 8, 1978, to Kenneth A. Elliott. Elliott employs a clip that engages a notch in the finger of the hook, however, such a notch is not a conventional part of commercially-available hooks.

SUMMARY OF THE INVENTION

The broad purpose of the present invention is to provide an improved pegboard hook retaining clip. The preferred embodiment of the invention comprises an elongated sheet metal clip, having a slot at one end for receiving the elbow of the hook. The opposite end of the retainer has a finger which wraps around the lower end of the hook to trap the hook shank between the finger and the pegboard. The clip is elongated to provide sufficient leverage to prevent the hook from being accidently removed without first swinging the clip out of its retaining position. The preferred clip is easily mounted, inexpensive, and reliable.

Still further objects and advantages of the invention will become readily apparent to those skilled in the art to which the invention pertains upon reference to the following detailed description.

DESCRIPTION OF THE DRAWING

The description refers to the accompanying drawings in which like reference characters refer to like parts throughout the several views, and in which.

DESCRIPTION OF THE PREFERRED EMBODIMENT

Figure 1:
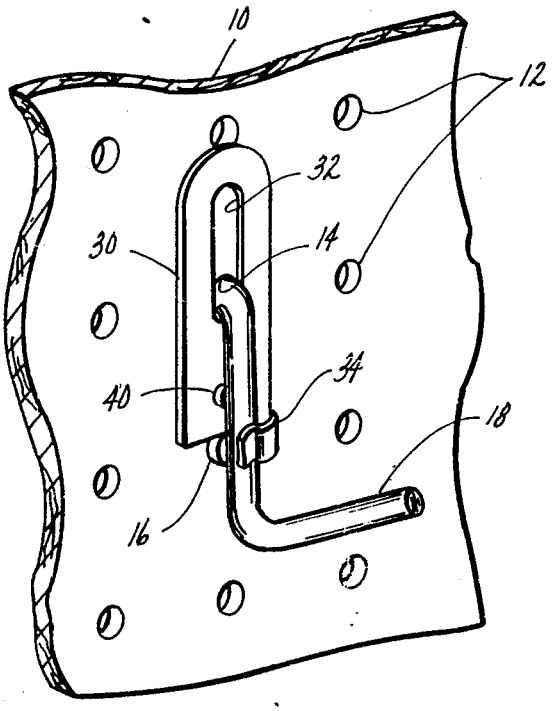
FIG. 1 is a perspective view illustrating a preferred retaining clip mounted on a pegboard hook and a section of pegboard.
Figure 2:
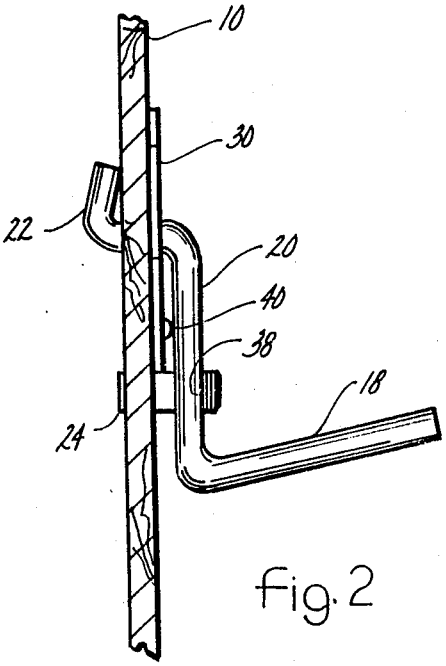
FIG. 2 is an elevational sectional view of the retaining clip.
Figure 4:
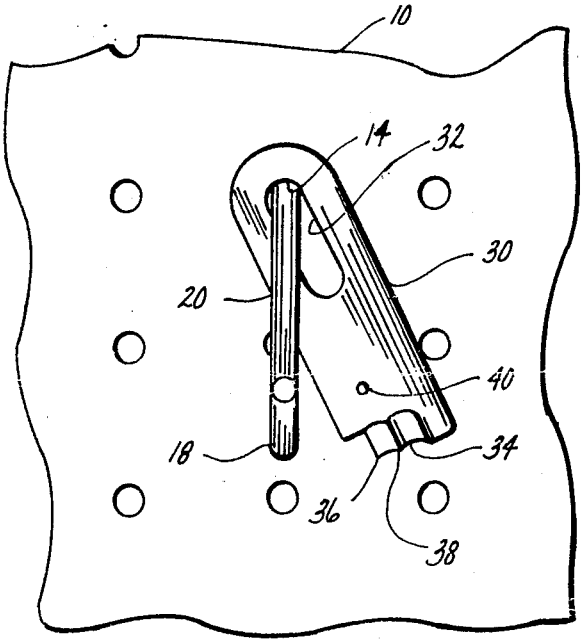
FIG. 4 is a view illustrating the retaining clip swung to the side to prevent the removal of the hook.

Referring to the drawing, a conventional pegboard 10 is illustrated in FIGS. 1 and 4, with plurality of uniformly spaced apertures 12 including a upper aperture 14 and a lower aperture 16.

A conventional commercially available metal hook 18 is illustrated mounted on the pegboard. Hook 18 is a wire metal element having a linear shank 20 supported parallel to the plane of pegboard 10. The hook has an elbow 22 at its upper end, received through aperture 14. The extreme end of the elbow is disposed somewhat parallel to the rear surface of the pegboard.

The hook also has a short finger 24 disposed at a right angle to shank 20 and is received through lower aperture 16.

Figure 3:
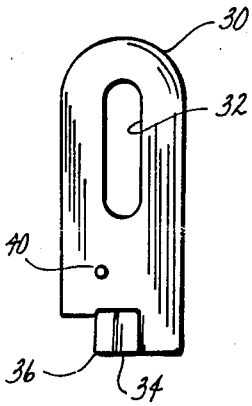
FIG. 3 is a view of the clip separated from the hook.

Retaining clip 30 has a sheet metal body with an elongated opening or slot 32 at one end for receiving elbow 22. The opposite end of the retainer has a bent tab 34 having a rounded configuration and a throat 38 for receiving and partially embracing the shank of the hook. A button 40 is mounted on the clip body, as illustrated in FIGS. 3 and 4, in a position so as to be disposed on the opposite side of the shank as the root of the tab. The difference between the height of the button and the height of the throat of the tab is less than the thickness of the shank. The tab is slightly resilient to open up to receive the shank as it is being fully received within the concave portion of the tab. The clip and the hook are then so combined that the clip can not be swung about the elbow of the hook unless a sufficient force is applied on the tab to open up the throat to pass the shank between the throat and the clip.

The clip and the hook are mounted on the pegboard by initially passing elbow 22 through slot 32 and then through upper opening aperture 14 of the pegboard. The clip is then swung from a position generally illustrated in FIG. 4, toward the lower end of the hook. The clip body is also raised to locate the upper end of the hook at the lower end of the 32. The clip is then snapped on the shank of the hook on the side opposite finger 24. In this position, as illustrated in FIG. 1, the hook is retained in position. The length of the clip body provides a sufficient leverage between the upper and lower ends of the clip to prevent hook finger 24 from being removed from the lower aperture 16. To remove the hook from the pegboard, the retaining clip is swung in the counter-clockwise direction, as illustrated in FIG. 4, to release the shank from the clip. The hook can then be removed from the pegboard in the usual manner.

Thus, it is to be understood that I have described an effective, but relatively inexpensive retaining clip for locking a conventional pegboard hook on a sheet of pegboard.

Having described my invention, I claim:

1. A retaining clip adapted for use with a pegboard hook mounted on a pegboard having first and second spaced apertures, the hook having an elongated shank supported parallel to the board, the hook having a first end and an integral elbow adjacent said first end receivable in the first aperture such that the first end of the hook is disposed on the opposite side of the pegboard as the shank, the hook having a finger receivable in the second aperture, the hook being removable from the pegboard by swinging the finger out of the second aperture and about said elbow, said retaining clip comprising:

an elongated plate-like body having a first end and a second end, the body having a longitudinal closed slot having a first slot end and a second slot end, the first slot end being disposed adjacent the first end of the body, the body having a tab retaining spaced from the second end of the slot a distance less than the distance between the elbow and the finger on the pegboard hook such that the clip body is receivable therebetween, the tab having a concave opening for receiving the shank of the hook by a motion of the clip body in a direction parallel to the board to a locked position in which the first end of the clip body is spaced from the hook's elbow and on the opposite side thereof as the tab, and the first end of the clip body is disposed on the pegboard on the opposite side thereof as the first end of the hook, whereby the tab releasably prevents the finger on the hook from being swung out of the second pegboard aperture.

2. A combination as defined in claim 1, in which the body is generally planar and the integral retaining cab is integral to the body.

3. A combination as defined in claim 1, in which the retaining clip has a planar body, and the tab extends in a direction normal to the plane of the body to form the concave opening for receiving the shank of the hook as the body is swung around the hook elbow.

4. A combination as defined in claim 3, in which the retaining tab forms a throat for receiving the hook shank.

5. A combination as defined in claim 3, in which the retaining tab is resilient, and the body has a button extending in the same direction as the tab, but on the opposite side of the shank to cooperate with the tab in trapping the shank between the button and the retaining tab.

6. A combination as defined in claim 1, in which the slot in the body is elongated in a direction parallel to the shank of the hook.

7. A combination as defined in claim 1, in which the body is elongated in the direction parallel to the shank of the hook.

8. A retaining clip as defined in claim 1, in which the tab receives the shank in said locked position adjacent the finger.

* * * * *